US010398275B2

(12) United States Patent
Kim et al.

(10) Patent No.: US 10,398,275 B2
(45) Date of Patent: Sep. 3, 2019

(54) ROBOT CLEANER

(71) Applicant: LG ELECTRONICS INC., Seoul (KR)

(72) Inventors: Hwang Kim, Seoul (KR); Jongsu Kim, Seoul (KR); Sungil Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 714 days.

(21) Appl. No.: 14/720,109

(22) Filed: May 22, 2015

(65) Prior Publication Data

US 2015/0335220 A1 Nov. 26, 2015

(30) Foreign Application Priority Data

May 23, 2014 (KR) ..... 10-2014-0062062
May 23, 2014 (KR) ..... 10-2014-0062063

(51) Int. Cl.
*A47L 11/00* (2006.01)
*A47L 11/282* (2006.01)
*A47L 9/04* (2006.01)

(52) U.S. Cl.
CPC ..... *A47L 11/282* (2013.01); *A47L 9/0477* (2013.01); *A47L 9/0483* (2013.01); *A47L 2201/00* (2013.01)

(58) Field of Classification Search
CPC ..... A47L 11/4041; A47L 11/17; A47L 11/18; A46B 7/10; A46B 13/001; A46B 13/005; A46B 13/006
USPC ..... 15/179, 181, 182, 183, 389, 49.1
See application file for complete search history.

(56) References Cited

U.S. PATENT DOCUMENTS 1,962,404 A * 6/1934 Nichols ..... D06F 53/005 15/256.6
2,271,551 A * 2/1942 Hoover ..... A47L 5/34 15/182
3,431,571 A * 3/1969 Kraus ..... A46B 13/02 15/179
5,375,284 A * 12/1994 Deimel ..... A47L 11/33 15/179

(Continued)

FOREIGN PATENT DOCUMENTS

GB 661906 A * 11/1951 ..... A47L 11/33
JP 2006326249 A 12/2006
JP 2010273872 A 12/2010

*Primary Examiner* — Joseph J Hail
*Assistant Examiner* — Shantese L McDonald
(74) *Attorney, Agent, or Firm* — Dentons US LLP

(57) ABSTRACT

A robot cleaner configured to elastically deform a brush part using contact force between bristles and a floor and then restoring the brush part to vibrate the bristles, thereby improving cleaning performance. The robot cleaner includes a case that moves on a floor, a brush shaft mounted to the case such that the brush shaft rotates by driving force from a drive unit, an elastic member fixed to the brush shaft, the elastic member made of an elastic material, and a brush part fixed to the elastic member, the brush part having bristles, wherein the brush part generates generate vibration during deformation and restoration of the elastic member when external force is applied. The elastic member deforms due to contact force between the bristles and the floor and is then restored, and the brush part vibrates during deformation and restoration of the elastic member.

15 Claims, 12 Drawing Sheets

(56) References Cited

U.S. PATENT DOCUMENTS

2014/0143962 A1* 5/2014 Mok ..... A61C 17/349
15/22.1

* cited by examiner

ROBOT CLEANER

CROSS-REFERENCE TO RELATED APPLICATION

This application claims the priority benefit of Korean Patent Application No. 10-2014-0062062 and 10-2014-0062063 filed on May 23, 2014 in the Korean Intellectual Property Office, the disclosure of which is incorporated herein by reference.

BACKGROUND OF THE INVENTION

1. Field of the Invention

The present invention relates to a robot cleaner.

2. Description of the Related Art

In general, a vacuum cleaner is a device that suctions air containing dust using vacuum pressure generated by a suction motor mounted in a main body of the cleaner and then filters foreign matter from the air in the main body of the cleaner.

The vacuum cleaner may be classified as a hand-operated vacuum cleaner which is directly manipulated by a user or a robot cleaner which autonomously performs a cleaning operation without user's manipulation.

The robot cleaner is a device that autonomously performs a cleaning operation while moving on a floor within a zone to be cleaned according to a program installed in the robot cleaner. The robot cleaner uses a rechargeable battery as a power source.

In general, the robot cleaner travels along a contour of a specific area surrounded by walls or obstacles which are sensed by a sensor mounted in a main body of the robot cleaner to set a cleaning zone and then plans a cleaning route necessary for cleaning the set cleaning zone. Subsequently, the robot cleaner drives wheels such that the wheels travel the planed cleaning route while calculating the travel distance and the current position of the robot cleaner from a signal detected through a sensor configured to detect the number of rotations of the wheels and a rotating angle of the wheels.

The robot cleaner is provided at a lower side thereof with a suction port, through which air containing dust is suctioned from the floor. The air suctioned through the suction port is collected in a dust collector disposed in the robot cleaner.

A rotary type brush is mounted in the robot cleaner, and bristles implanted in the brush float dust or foreign matter from the floor.

An example of such a conventional robot cleaner is disclosed, for example, in Korean Patent Application Publication No. 10-2013-0025309.

In the conventional robot cleaner, however, a contact angle between the bristles and carpet pile is great with the result that it is difficult to convey dust to the suction port.

SUMMARY OF THE INVENTION

It is an object of the present invention to provide a robot cleaner that is capable of elastically deforming a brush part using contact force between bristles and a floor and then restoring the brush part to vibrate the bristles, thereby improving cleaning performance.

It is another object of the present invention to provide a robot cleaner that is capable of enabling bristles to contact a carpet at a predetermined inclined angle, thereby improving cleaning performance.

It is another object of the present invention to provide a robot cleaner that is capable of rotating and revolving brush modules.

It is another object of the present invention to provide a robot cleaner that is capable of effectively separating foreign matter from carpet pile using brush modules that can be rotated while being revolved.

It is a further object of the present invention to provide a robot cleaner that is capable of increasing contact time between bristles and a floor.

In accordance with an aspect of the present invention, the above and other objects can be accomplished by the provision of a robot cleaner including a case configured to move along a floor, a brush shaft mounted to the case such that the brush shaft is rotated by driving force from a drive unit, an elastic member fixed to the brush shaft, the elastic member being made of an elastic material, and a brush part fixed to the elastic member, the brush part having bristles, the brush part configured to generate vibration during deformation and restoration of the elastic member when external force is applied.

In accordance with another aspect of the present invention, there is provided a robot cleaner including a case configured to move along a floor and a brush module disposed at a lower side of the case, the brush module having bristles configured to contact the floor, wherein the brush module includes a brush shaft mounted to the case such that the brush shaft is rotated by driving force from a drive unit, an elastic member fixed to the brush shaft, the elastic member being made of an elastic material, a brush part fixed to the elastic member, the brush part having bristles, the brush part configured to generate vibration during deformation and restoration of the elastic member when external force is applied, and the bristles disposed at the brush part such that the bristles contact the floor during rotation of the brush part.

In accordance with a further aspect of the present invention, there is provided a robot cleaner including a case configured to move along a floor and an agitator unit disposed at a lower side of the case, the agitator unit including a plurality of brush modules having bristles configured to contact the floor, wherein the agitator unit includes the brush modules each having a brush shaft about which each of the brush modules is rotated, brush gears fixed to the respective brush modules, an inscribed gear fixed to the case such that the brush gears are engaged with the inscribed gear, and a drive unit configured to revolve the brush gears along the inscribed gear and to rotate the brush gears about the respective brush shafts in a direction opposite to the revolving direction in a state in which the brush gears are engaged with the inscribed gear.

The details of other embodiments are contained in the detailed description of the invention and the accompanying drawings.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
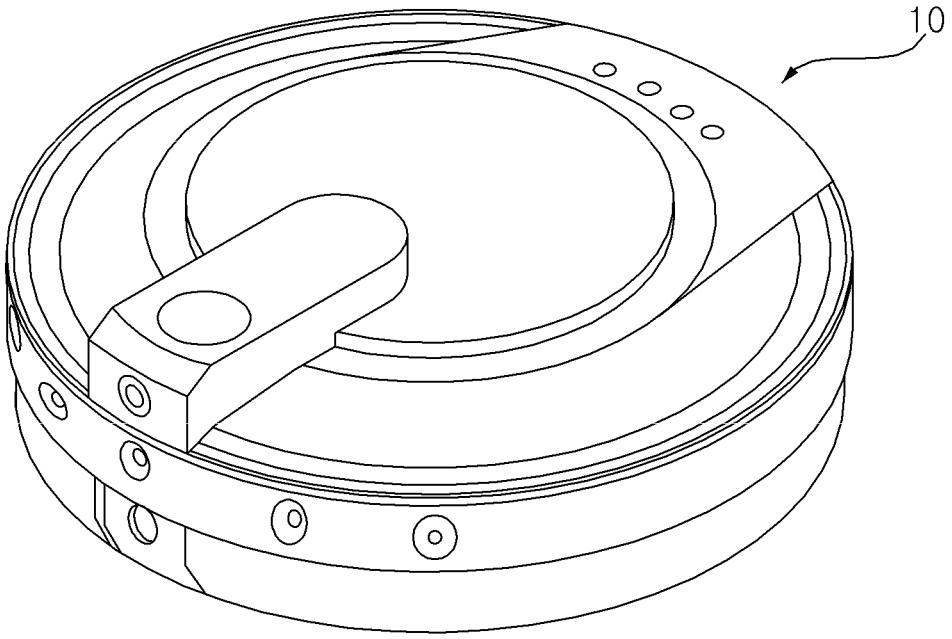
FIG. 1 is a perspective view showing a robot cleaner according to a first embodiment of the present invention.

Advantages, features and methods for achieving those of embodiments may become apparent upon referring to embodiments described later in detail together with attached drawings. However, embodiments are not limited to the embodiments disclosed hereinafter, but may be embodied in different modes. The embodiments are provided for perfection of disclosure and informing a scope to persons skilled in this field of art. The same reference numbers may refer to the same elements throughout the specification.

Hereinafter, embodiments of the present invention will be described with reference to the attached drawings, which are provided to describe a robot cleaner.

First, a robot cleaner according to a first embodiment of the present invention will be described with reference to FIGS. 1 to 4.

Referring to FIGS. 1 to 4, the robot cleaner according to this embodiment includes a case 10 configured to move along a floor, a suction module (not shown) mounted at the case 10 for forming suction force necessary to suction air into the case 10, a dust tank module (not shown) mounted at the case 10 for separating foreign matter from the air suctioned through the suction module and storing the separated foreign matter, a traveling module (not shown) mounted at the case 10 for providing driving force to the case 10 such that the case 10 is moved, a sensor module (not shown) mounted at the case 10 for sensing a state and situation around the case 10, and a brush module 100 mounted at the case 10 such that the brush module 100 is connected to the suction module for guiding external air to the suction module.

The suction module rotates a fan using rotational force generated by a motor to suction external air into the case 10. The suction module is an ordinary component well known by those skilled in the art, and therefore, a detailed description thereof will be omitted.

The dust tank module filters foreign matter, such as dust, from air suctioned from the outside through the suction module and stores the filtered foreign matter. A filter type dust tank module or a cyclone type dust tank module may be used as the dust tank module. The dust tank module is an ordinary component well known by those skilled in the art, and therefore, a detailed description thereof will be omitted.

The traveling module travels the case 10. The traveling module includes a traveling wheel (not shown) and a traveling motor (not shown) for driving the traveling wheel. The traveling module is an ordinary component well known by those skilled in the art, and therefore, a detailed description thereof will be omitted.

The sensor module senses or recognizes a situation around the robot cleaner. A vision sensor or an infrared sensor may be used as the sensor module. The sensor module is an ordinary component well known by those skilled in the art, and therefore, a detailed description thereof will be omitted.

The brush module 100 is mounted at a lower side of the case 10.

The brush module 100 is rotated by driving force such that bristles 111 contact a floor according to the rotation of the brush module 100.

In this embodiment, the brush module 100 is configured such that brush parts 110 are elastically deformed by force generated when the bristles 111 contact the floor and then restored.

The bristles 111 are vibrated through elastic deformation and restoration of the brush parts 110, thereby improving cleaning efficiency.

To this end, the brush module 100 according to this embodiment includes a brush shaft 101, an elastic member 120 fixed to the brush shaft 101, the elastic member 120 being made of an elastic material, and the brush parts 110 configured to generate vibration during deformation and restoration of the brush parts 110 due to elastic force of the elastic member 120.

An agitator unit includes the brush module 100 and a drive unit 1140 (see FIG. 8) configured to provide driving force to the brush shaft 101.

Figure 8:
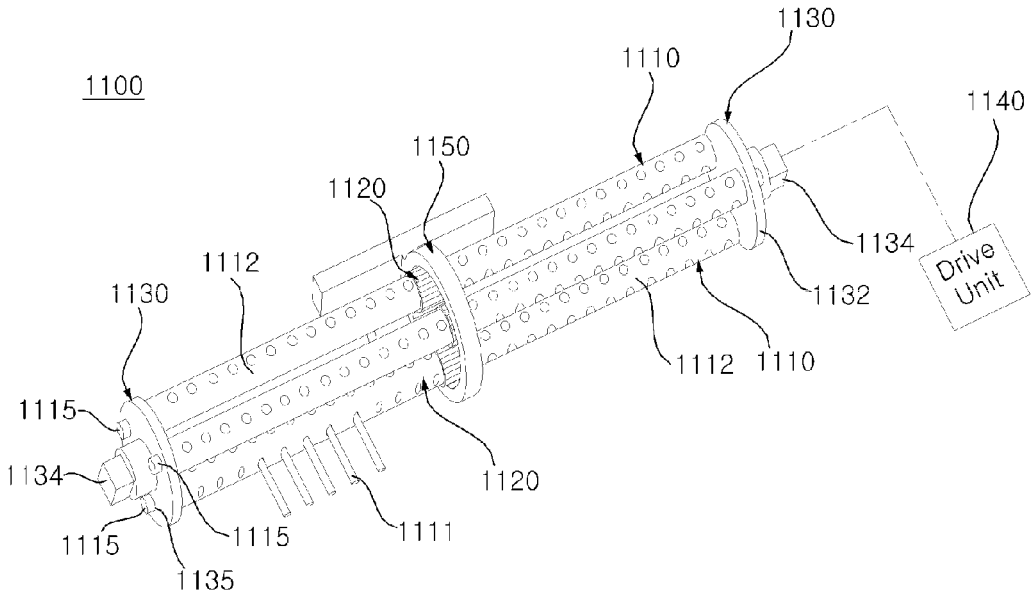
FIG. 8 is a perspective view showing an agitator unit according to a fifth embodiment of the present invention.

The brush shaft 101 is rotated by the driving force received from the drive unit 1140 (see FIG. 8).

The drive unit 1140 transmits the driving force to coupling member bodies 102 through a driving force transmission part 1134.

The brush shaft 101 is assembled to the coupling member bodies 102.

In this embodiment, the coupling member bodies 102, which are driving force transmission members, are mounted at opposite ends of the brush shaft 101, and the drive unit 1140 transmits the driving force to the coupling member bodies 102 to rotate the brush module 100.

In a case in which the drive unit 1140 is a motor configured to generate rotational force, a gear, a chain, and a belt may be connected to the coupling member bodies 102 to transmit driving force to the coupling member bodies 102.

In particular, an additional motor for the brush module 100 may be provided. Alternatively, driving force from the traveling module may be transmitted to brush module 100.

The elastic member 120 is fixed to the brush shaft 101. In this embodiment, the elastic member 120 is integrally formed at the brush shaft 101 by double injection.

The elastic member 120 extends in a longitudinal direction of the brush shaft 101.

The elastic member 120 is made of a synthetic resin material exhibiting elasticity.

In this embodiment, the elastic member 120 includes a elastic member body 122 and elastic member fixing parts 124 formed at the outer circumference of the elastic member body 122 in a protruding fashion such that the elastic member fixing parts 124 are coupled to the brush parts 110.

The elastic member fixing parts 124 protrude from the outer circumference of the elastic member body 122 in a state in which the elastic member fixing parts 124 extend in a longitudinal direction of the elastic member body 122.

The number of the elastic member fixing parts 124 corresponds to that of the brush parts 110. In this embodiment, three brush parts 110 are provided, and three elastic member fixing parts 124 are provided correspondingly.

The elastic member fixing parts 124 protrude in a radial direction of the brush shaft 101.

The elastic member fixing parts 124 are formed about an axis of the brush shaft 101 at intervals of 120 degrees.

The elastic member fixing parts 124 and the brush parts 110 are engaged with each other in a circumferential direction. When the brush shaft 101 is rotated, therefore, driving force is transmitted to the brush parts 110 via the elastic member body 122.

Figure 2:
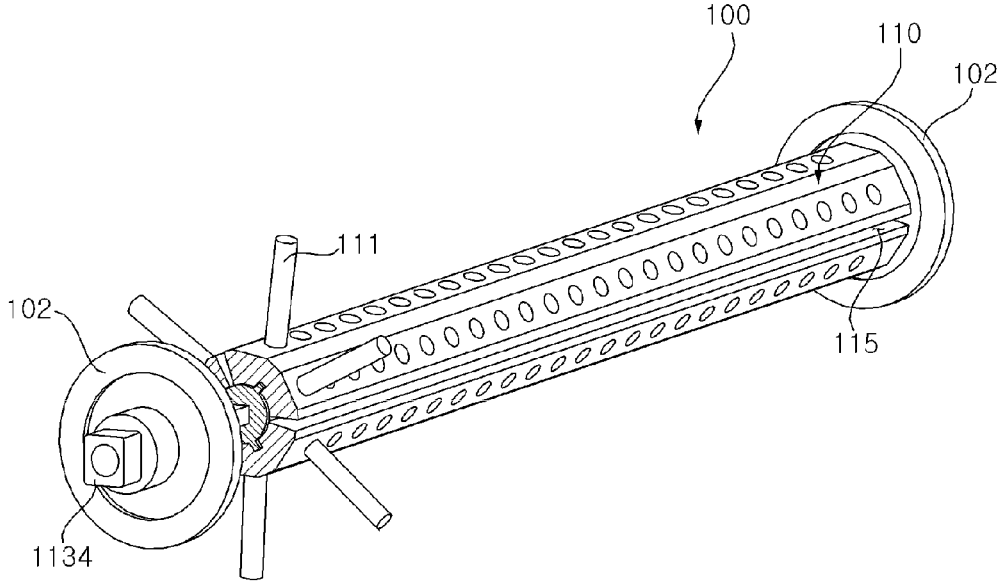
FIG. 2 is a partially cutaway perspective view showing a brush module according to a first embodiment of the present invention.
Figure 3:
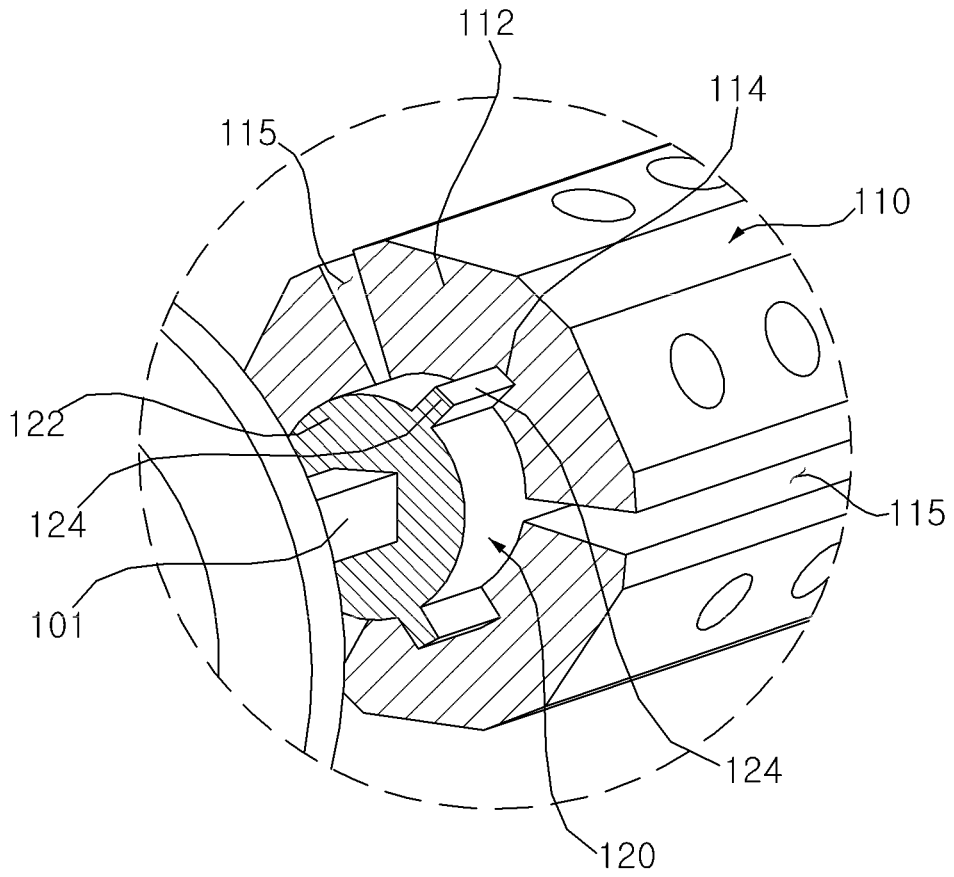
FIG. 3 is a partially cutaway perspective view showing a coupling structure of the brush module shown in FIG. 2.
Figure 4:
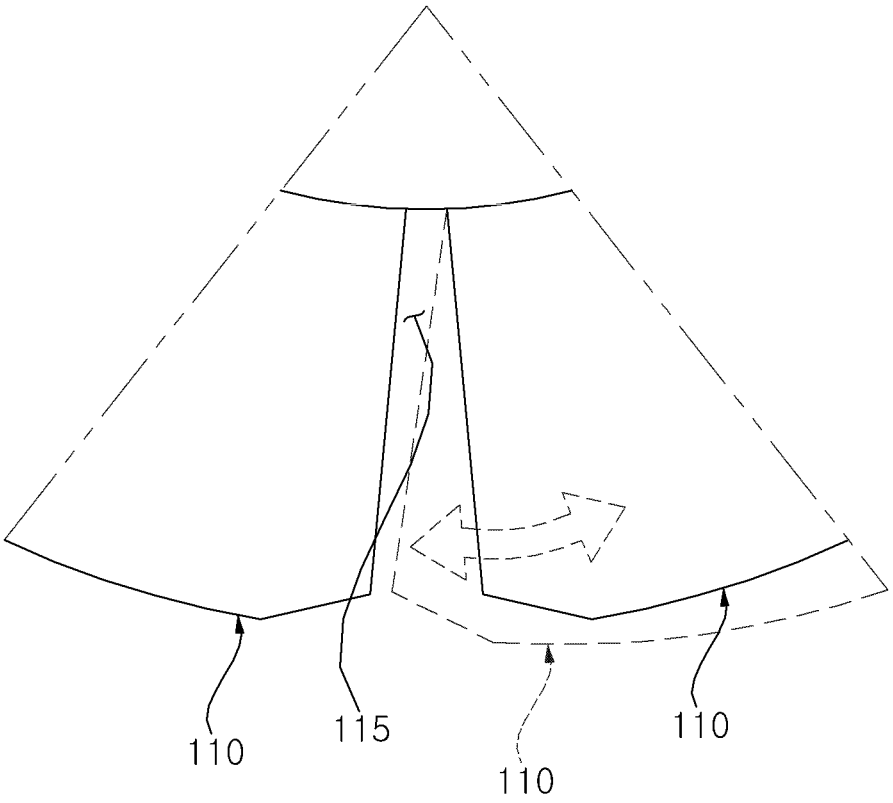
FIG. 4 is an illustrative view showing a deformed state of a brush body shown in FIG. 2.

Bristles 111 are implanted in the brush parts 110. In FIG. 2, the bristles 111 are shown as being implanted in first rows of the brush parts 110. However, the bristles 111 may be implanted in all rows of the brush parts 110.

When the bristles 111 contact a floor, reaction force caused by frictional force between the bristles 111 and the floor is applied to the brush parts 110, and the elastic member 120 is elastically deformed due to the reaction force.

Each of the brush parts 110 includes a brush body 112, at which the bristles 111 are disposed, and a brush fixing part 114 formed at the brush body 112 such that the brush fixing part 114 is coupled to a corresponding one of the elastic member fixing parts 124.

In this embodiment, the elastic member fixing parts 124 protrude toward the respective brush parts 110, and the brush fixing part 114 is formed in the shape of a groove, into which a corresponding one of the elastic member fixing parts 124 is inserted.

Unlike this embodiment, the brush fixing part 114 and a corresponding one of the elastic member fixing parts 124 may be formed in shapes opposite to the above shapes.

Furthermore, the brush fixing part 114 and a corresponding one of the elastic member fixing parts 124 may be coupled to each other in a fitting fashion, or the brush fixing part 114 may be fixed to a corresponding one of the elastic member fixing parts 124 via a fastening member (not shown) provided to fasten and fix the brush parts 110 to the elastic member 120.

The brush body 112 may be made of a solid material such that the brush body 112 transmits external force to the elastic member 120.

In this embodiment, the brush parts 110 are fixed to the elastic member 120 in a state in which the brush parts 110 are spaced apart from each other to form a displacement space 115 between every two neighboring ones of the brush parts 110. In this embodiment, three brush parts 110 are provided, and the displacement space 115 is formed between every two neighboring ones of the brush parts 110.

In this embodiment, the elastic member 120 is formed at the outer circumference of the brush shaft 101 by double injection such that the elastic member 120 surrounds the brush shaft 101. Unlike this embodiment, a plurality of elastic members 120 may be provided such that the elastic members 120 correspond to the respective brush parts 110.

When external force is applied to the brush body 112, the external force is transmitted to the elastic member 120, to which the brush body 112 is mounted, to elastically deform the elastic member 120. the brush body 112 may move in the displacement space 115 due to elastic deformation of the elastic member 120.

Subsequently, the brush body 112 may move to the original position thereof during restoration of the elastic deformation of the elastic member 120.

In this way, the brush body 112 according to this embodiment may generate vibration during elastic deformation and restoration of the elastic member 120.

The brush module 100 is disposed in a lateral direction of the robot cleaner. The brush module 100 generates vibration back and forth in an advancing direction of the robot cleaner when the bristles 111 contact the floor.

Cleaning performance of the bristles is maximized due to the generated vibration.

A second embodiment of the present invention will be described with reference to FIG. 5.

Figure 5:
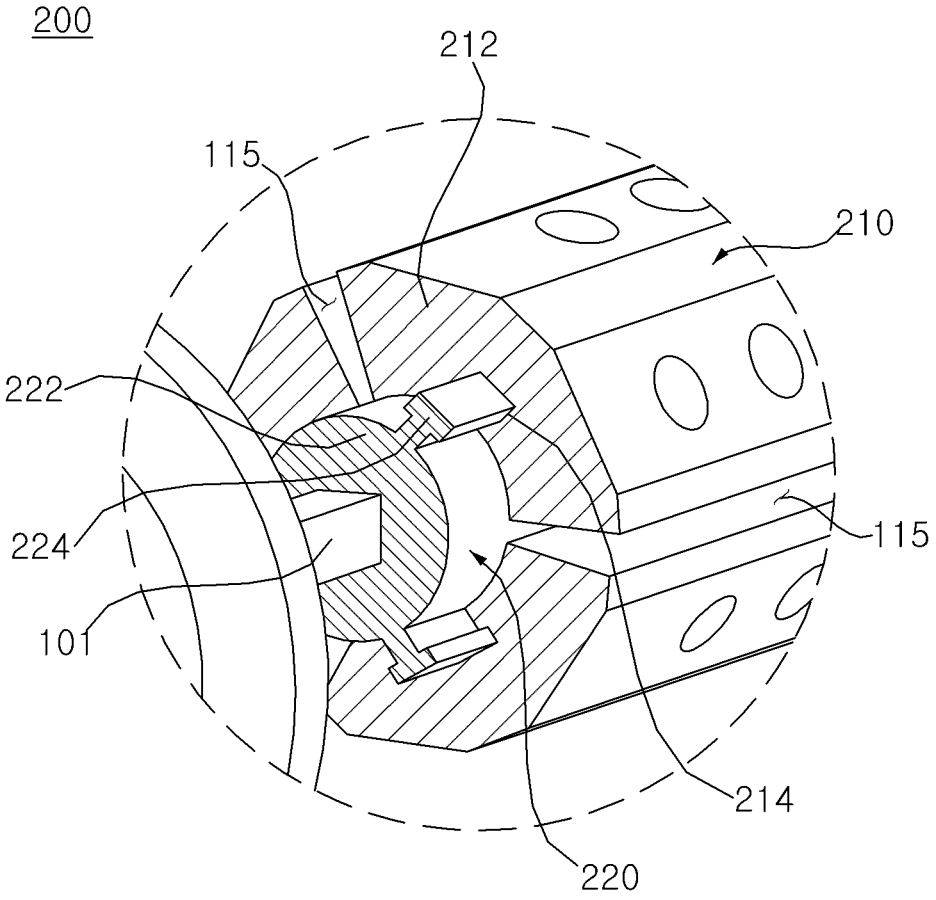
FIG. 5 is a partially cutaway perspective view showing a coupling structure of a brush module according to a second embodiment of the present invention.

Referring to FIG. 5, in a brush module 200 according to this embodiment, each elastic member fixing part 224 of an elastic member 220 is coupled to a brush fixing part 214 of a corresponding brush part 210 in a fitting fashion.

The elastic member fixing part 224 is formed in the shape of a T-shaped protrusion.

The elastic member fixing part 224 extends in a longitudinal direction of the brush shaft 101.

The brush fixing part 214 is formed in the shape of a T-shaped groove.

When the elastic member fixing part 224 is coupled to the brush fixing part 214 in a sliding fashion, the brush part 210 is coupled to the elastic member 220.

When the brush part 210 is coupled to the elastic member 220, it is possible to prevent the brush part 210 from being separated in a circumferential direction and a radial direction of the brush shaft 101.

The other components of this embodiment are identical in construction to those of the first embodiment, and therefore a detailed description thereof will be omitted.

A third embodiment of the present invention will be described with reference to FIG. 6.

Figure 6:
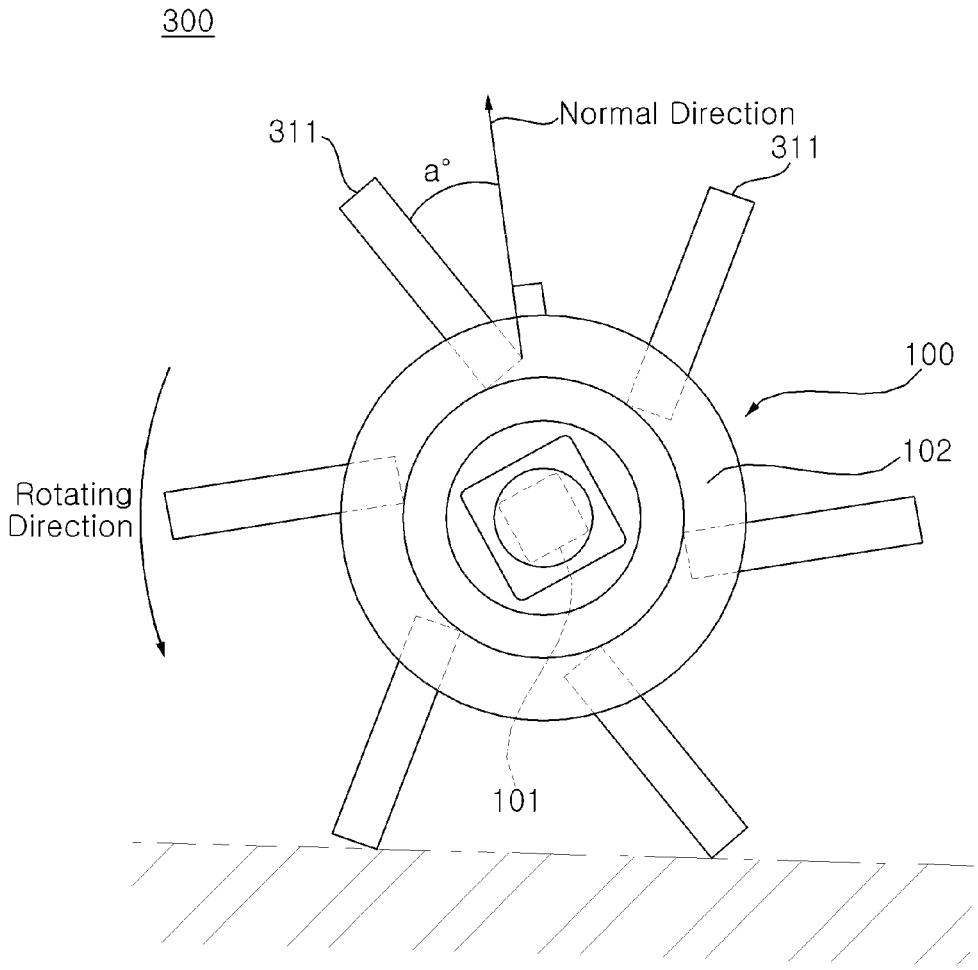
FIG. 6 is a left side view of a brush module showing a mount angle of bristles according to a third embodiment of the present invention.

Referring to FIG. 6, in a brush module 300 of a robot cleaner according to this embodiment, each bristle 311 is not mounted in a normal direction of a corresponding brush part 110 but is inclined at a predetermined angle a with respect to the normal direction of the brush part 110 unlike the first embodiment.

That is, the bristle 311 may be inclined in a rotating direction of the brush module 300.

In a case in which the bristle 311 is inclined as described above, when the bristle 311 contacts a fabric floor, such as a carpet, the end of the bristle 311 may deeply penetrate carpet pile.

As the bristle 311 deeply penetrates the carpet pile, it is possible to effectively separate foreign matter from the carper pile, whereby improving cleaning performance.

Furthermore, in a case in which the bristle 311 is inclined with respect to the normal direction of the brush part 110, the bristle 311 contacts the floor in a state in which an angle between the bristle 311 and the floor is an acute angle or an obtuse angle. As a result, the bristle 311 is supported by stronger force.

The other components of this embodiment are identical in construction to those of the first embodiment, and therefore a detailed description thereof will be omitted.

A fourth embodiment of the present invention will be described with reference to FIG. 7.

Figure 7:
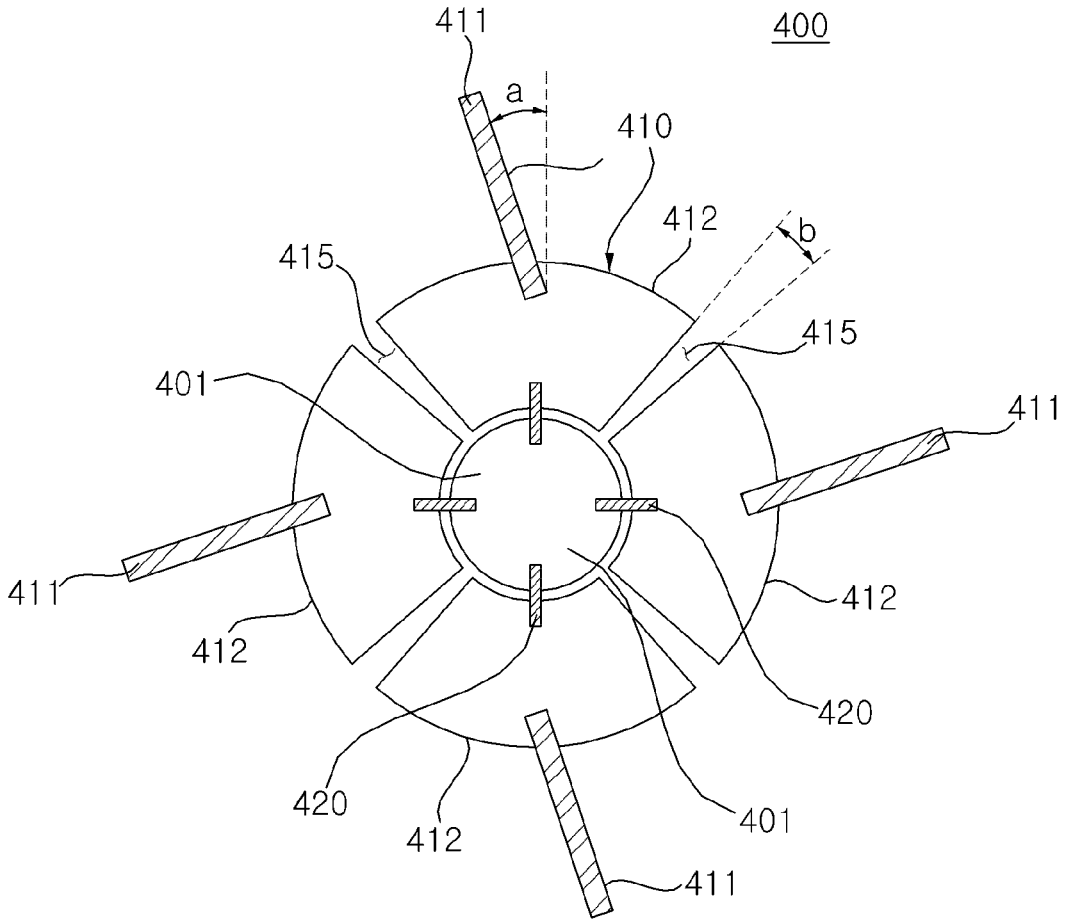
FIG. 7 is a sectional view showing a brush module according to a fourth embodiment of the present invention.

Referring to FIG. 7, in a brush module 400 according to this embodiment, each brush part 410 is spaced apart from a brush shaft 401, and the brush part 410 is connected to the brush shaft 401 via an elastic member 420.

The elastic member 420 may be made of a metal material. The elastic member 420 may be elastically deformed due to external force of the brush shaft in a circumferential direction.

In this embodiment, the elastic member 420 is formed in the shape of a plate. The inner end of the elastic member 420 is fixed to the brush shaft 401, and the outer end of the elastic member 420 is fixed to the brush part 410.

When the brush module 400 is driven, and external force is applied to the brush part 410, the external force is transmitted to the elastic member 420. As a result, the brush part 410 is displaced in a circumferential direction.

During deformation and restoration of the elastic member 420, vibration may be generated from the brush part 410.

In this embodiment, damping force between the brush part 410 and the brush shaft 401 is small, whereby it is possible to maintain vibration longer.

A displacement space 415 is formed between every two neighboring ones of the brush parts 410. The displacement space 415 has a predetermined angle b.

In addition, each bristle 411 is inclined with respect to a normal direction of the brush shaft 401.

The other components of this embodiment are identical in construction to those of the first embodiment, and therefore a detailed description thereof will be omitted.

A fifth embodiment of the present invention will be described with reference to FIGS. 8 to 10.

Figure 9:
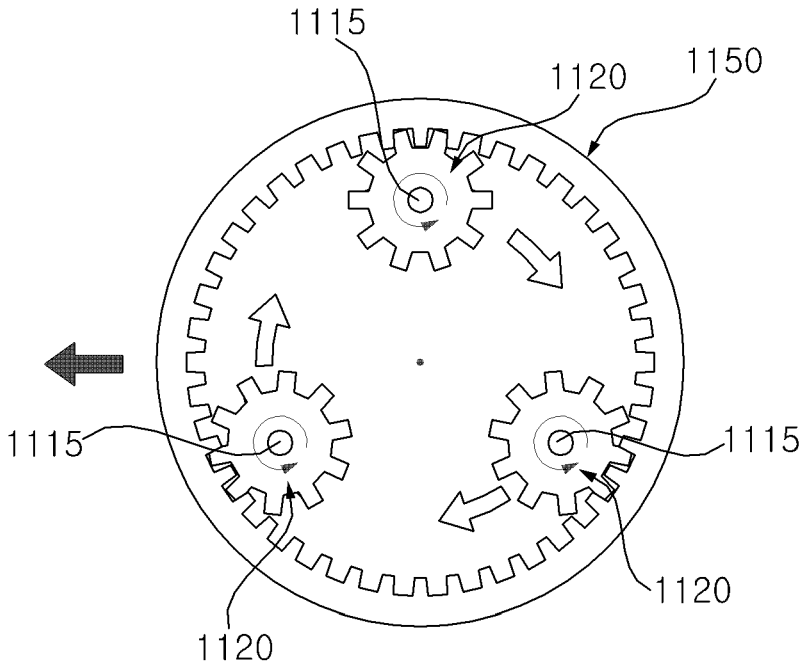
FIG. 9 is a sectional view showing a power transmission structure of the agitator unit shown in FIG. 8.
Figure 10:
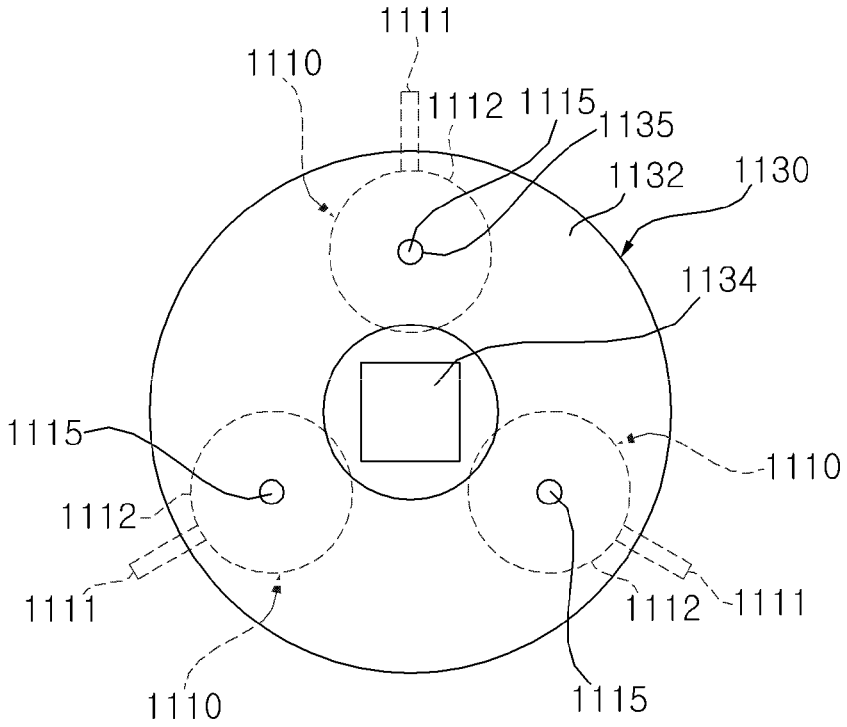
FIG. 10 is a right side view of the agitator unit shown in FIG. 8.

Referring to FIGS. 8 to 10, an agitator unit 1100 according to this embodiment is configured such that a plurality of brush modules 1110 is revolved while being rotated.

To this end, the agitator unit 1100 according to this embodiment includes a plurality of brush modules 1110, brush gears 1120 fixed to the respective brush modules 1110, brush coupling members 1130 to which the brush modules 1110 are assembled in a state in which the brush modules 1110 are rotatably coupled to the brush coupling members 1130, a drive unit 1140 configured to provide driving force to the brush coupling members 1130, and an inscribed gear 1150 having inscribed teeth formed at the inner circumference thereof such that the brush gears 1120 are engaged with the inscribed teeth, the inscribed gear 1150 enabling the brush modules 1110 to be rotated and revolved through engagement with the brush gears 1120 when the brush coupling members 1130 are rotated.

The brush modules 1110 are disposed in the case 110. A plurality of bristles 1111 is implanted in each of the brush modules 1110 such that the bristles 1111 contact a floor.

The brush modules 1110 extend in a right and left direction perpendicular to an advancing direction of the robot cleaner.

When driving force is transmitted to the brush modules 1110 in a state in which the brush modules 1110 are engaged with the inscribed gear 1150, the brush modules 1110 revolve along the inner circumference of the inscribed gear 1150. During revolution of the brush modules 1110, the brush modules 1110 are also rotated.

Rotation and revolution of the brush modules 1110 maximize an agitating effect.

In this embodiment, three brush modules 1110 are provided. Unlike this embodiment, two brush modules may be provided. Otherwise, four or more brush modules may be provided.

Each of the brush modules 1110 includes a brush body 1112, in which bristles 1111 are implanted, and a brush shaft 1115 connected between the brush body 1112 and a corresponding one of the brush coupling members 1130 for forming a rotation axis of the brush body 1112.

The inscribed gear 1150 is fixed to the case 110. The inscribed gear 1150 is provided at the inner circumference thereof with teeth, which are engaged with the brush gears 1120.

The brush gears 1120 are fixed to the respective brush modules 1110. Each of the brush gears 1120 is provided at the outer circumference thereof with teeth, which are engaged with the teeth of the inscribed gear 1150.

In this embodiment, each of the brush gears 1120 is mounted to the middle of a corresponding one of the brush modules 1110. Unlike this embodiment, each of the brush gears 1120 may be mounted to one end of a corresponding one of the brush modules 1110. The inscribed gear 1150 is disposed at a position corresponding to the middle of each of the brush modules 1110 such that the inscribed gear 1150 are engaged with the brush gears 1120.

In this embodiment, the teeth of the brush gears 1120 and the inscribed gear 1150 may be spur gear teeth or helical gear teeth.

The brush modules 1110 are simultaneously fixed to the brush coupling members 1130.

The brush coupling members 1130 are rotated along the inner circumference of the inscribed gear 1150 to revolve the brush modules 1110.

During revolution of the brush modules 1110, the brush modules 1110 are rotated about the respective brush shafts 1115.

Each of the brush coupling members 1130 includes a coupling member body 1132 coupled to the brush modules 1110 via the respective brush shafts 1115, a driving force transmission part 1134 formed at the coupling member body 1132 such that the driving force transmission part 1134 is connected to the drive unit 1140, and coupling member shaft holes 135 formed at the coupling member body 1132 such that the brush shafts 1115 are inserted into the respective coupling member shaft holes 1135.

In this embodiment, the brush coupling members 1130 are disposed at opposite ends of the brush modules 1110.

In this embodiment, the coupling member body 1132 is formed in the shape of a disk. However, the coupling member body 1132 may have various shapes.

The driving force transmission part 1134 is connected to the drive unit 1140. The driving force transmission part 1134 may have various shapes based on the type of the drive unit 1140 or the kind of the driving force.

For example, in a case in which the drive unit 1140 is a motor that generates rotational force, the driving force transmission part 1134 may be connected to a gear, a chain, a belt, etc. such that the driving force transmission part 1134 receives the rotational force.

In addition, the drive unit 1140 may include an additional motor for the agitator unit 1100. In this case, the driving force transmission part 1134 may receive driving force from the traveling module.

The rotation speed and the revolution speed of the brush gears 1120 may be variously adjusted based on a gear ratio between the inscribed gear 1150 and the brush gears 1120.

Hereinafter, the operation of the agitator unit according to this embodiment will be described in more detail with reference to FIGS. 8 to 10.

In this embodiment, the inscribed gear 1150 of the agitator unit 1100 is fixed to the case 110. When the brush coupling members 1130 are rotated by driving force, therefore, the brush coupling members 1130 transmit the driving force to the brush modules 1110 through engagement between the brush gears 1120 and the inscribed gear 1150.

When the brush coupling members 1130 are rotated, the brush gears 1120 revolve along the inner circumference of the inscribed gear 1150 through engagement between the brush gears 1120 and the inscribed gear 1150.

During revolution of the brush gears 1120, the brush modules 1110 are rotated about the respective brush shafts 1115.

In this embodiment, the brush modules 1110 are rotated in a direction identical to the advancing direction of the robot cleaner and revolved in a direction opposite to the advancing direction of the robot cleaner.

For example, when the brush coupling members 1130 are rotated in a clockwise direction through the drive unit, the brush modules 1110 connected to the brush coupling members 1130 revolve along the inner circumference of the inscribed gear 1150 in the clockwise direction (the advancing direction of the robot cleaner).

During revolution of the brush gears 1120, the brush gears 1120 are rotated in a counterclockwise direction (a direction opposite to the advancing direction of the robot cleaner), and the brush modules 1110 are also rotated in the counterclockwise direction (the direction opposite to the advancing direction of the robot cleaner), since the brush modules 1110 are engaged with the inscribed gear 1150.

The rotating direction of the brush coupling members 1130 is opposite to that of the brush modules 1110, whereby it is possible to increase time for which the bristles 111 contact the floor.

The bristles 111 are implanted in the outer circumference of each brush body 1112. Consequently, the bristles 111 are also rotated. In this case, the bristles 111 are rotated in a state in which the bristles 111 are affected by the revolution and the rotation of the brush modules 1110.

At this time, the rotating direction of the brush coupling members 1130 is opposite to that of the brush modules 1110 in a zone in which the bristles 111 contact the floor. Consequently, it is possible to increase time for which the bristles 111 contact the floor during travel of the robot cleaner as compared with a conventional brush type agitator.

In addition, in a case in which a larger number of brush modules 1110 are provided than in this embodiment, it is possible to further increase the number of contact between the floor and the bristles 111 and time for which the bristles 111 contact the floor.

In addition, the gear ratio between the inscribed gear 1150 and the brush gears 1120 may be adjusted to rotate the brush modules 1110 at a higher speed than the brush coupling members 1130.

In addition, the gear ratio between the inscribed gear 1150 and the brush gears 1120 may be adjusted to rotate the brush modules 1110 at a lower speed than the brush coupling members 1130, whereby it is possible to increase torque applied to the brush modules 1110.

Meanwhile, in this embodiment, the brush coupling members 1130 are rotated in the clockwise direction. Unlike this embodiment, however, the brush coupling members 1130 may be rotated in the counterclockwise direction such that the brush modules 1110 are revolved in the counterclockwise direction and rotated in the clockwise direction.

In addition, unlike this embodiment, one brush module 1110 and one brush gear 1120 may be provided such that the brush module 1110 are revolved while being rotated.

In addition, unlike this embodiment, driving force may be provided to rotate the brush modules 1110, and additional driving force may be provided to the brush coupling members 1130 such that the brush modules 1110 are revolved. In this case, the brush gears 1120 are not engaged with the inscribed gear 1150.

Meanwhile, unlike this embodiment, the brush module 100 of the first embodiment may be provided instead of the brush modules 1110.

In this case, it is possible to increase time for which the bristles 111 contact the floor and, in addition, to further improve cleaning performance through vibration of the bristles 111 of the first embodiment.

The other components of this embodiment are identical in construction to those of the first embodiment, and therefore a detailed description thereof will be omitted.

A sixth embodiment of the present invention will be described with reference to FIG. 11.

Figure 11:
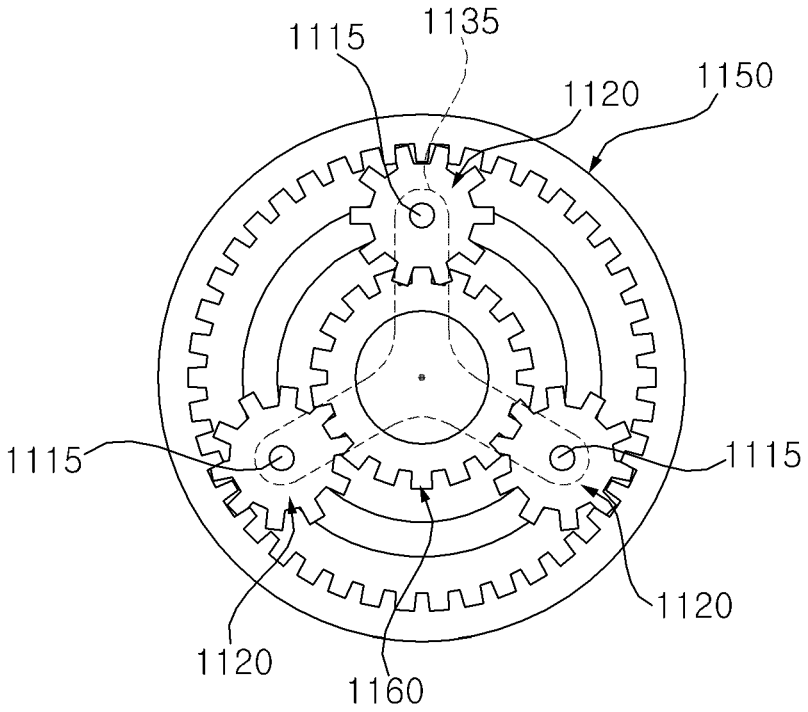
FIG. 11 is a sectional view showing a power transmission structure of an agitator unit according to a sixth embodiment of the present invention.

Referring to FIG. 11, in an agitator unit according to this embodiment, a sun gear 1160 is disposed among the brush gears 1120, and driving force is provided to the sun gear 1160 to rotate and revolve the brush gears 1120, unlike the fifth embodiment.

Similarly to the fifth embodiment, a brush coupling member 1135 is coupled to brush gears 1120, and the brush modules 1110 are coupled to the brush coupling member 1135 such that the brush modules 1110 can be rotated about the respective brush shafts 1115.

Consequently, the brush modules 1110 and the brush gears 1120 are revolved along the inner circumference of the inscribed gear 1150.

In the same manner as in the first embodiment, the inscribed gear 1150 is fixed to the case 110.

The sun gear 1160 is disposed among the brush gears 1120. The sun gear 1160 is simultaneously engaged with the brush gears 1120.

Particularly, in this embodiment, drive force is provided to the sun gear 1160.

When the sun gear 1160 is rotated in a state in which the inscribed gear 1150 is fixed, therefore, the brush coupling member 1135 is revolved in a direction identical to the rotating direction of the sun gear 1160, and the brush modules 1110 are rotated in a direction opposite to the rotating direction of the sun gear 1160.

That is, when the driving force is transmitted to the sun gear 1160 such that the sun gear 1160 is rotated, the brush modules 1110 are operated in a state in which a direction in which the brush modules 1110 are rotated and a direction in which the brush modules 1110 are revolved are opposite to each other in the same manner as in the fifth embodiment.

Meanwhile, unlike this embodiment, driving force may be transmitted to the brush coupling member 1135 in a state in which the inscribed gear 1150 is fixed.

In this case, when the brush coupling member 1135 is rotated, the sun gear 1160 is rotated in a direction identical to the rotating direction of the brush coupling member 1135, and the brush gears 1120 are rotated in a direction opposite to the rotating direction of the brush coupling member 1135.

In this way, even in this embodiment, the direction in which the brush modules 1110 are revolved and the direction in which the brush modules 1110 are rotated are opposite to each other, thereby achieving the same performance as in the fifth embodiment.

The other components of this embodiment are identical in construction to those of the fifth embodiment, and therefore a detailed description thereof will be omitted.

A seventh embodiment of the present invention will be described with reference to FIG. 12.

Figure 12:
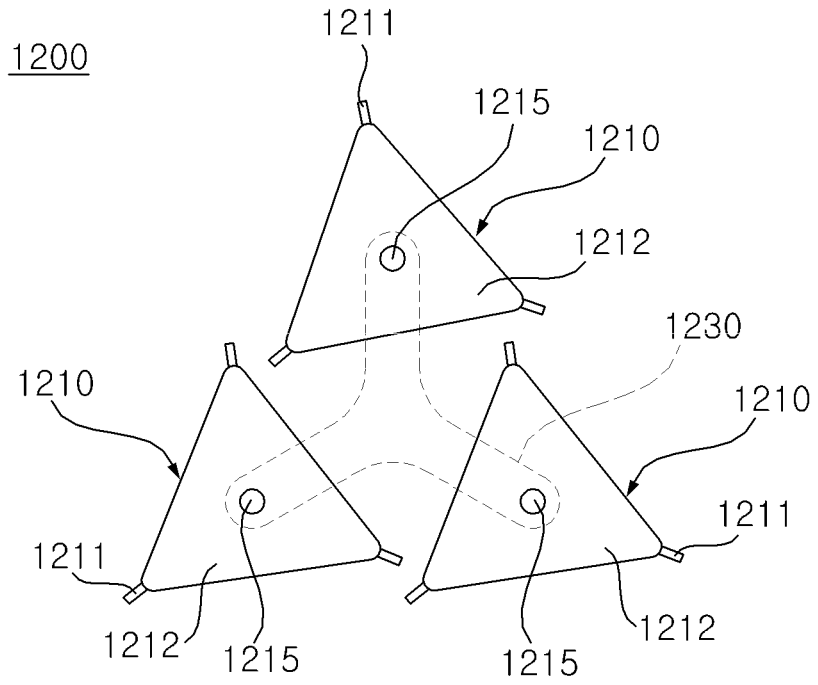
FIG. 12 is a side view showing an agitator unit according to a seventh embodiment of the present invention.

Referring to FIG. 12, in an agitator unit 1200 according to this embodiment, a plurality of brush modules 1210 formed in a polygonal shape is provided unlike the sixth embodiment. Bristles 1211 are disposed at vertices of each polygon. In addition, the bristles 1211 are radially disposed with respect to each brush shaft 1215.

The brush modules 1210 are connected to a brush coupling member 1230 such that the brush modules 1210 are revolved in the same manner as in the first embodiment.

Brush gears (not shown) are engaged with the inscribed gear 1150 in a state in which the brush gears fixed to the respective brush modules 1210 in the same manner as in the first embodiment.

The agitator unit 1200 according to this embodiment is operated based on the same mechanism as in the first embodiment. In this embodiment, however, the shape of the brush modules 1210 may be changed to improve contact strength and a contact angle between the bristles 1211 and the floor.

In this embodiment, each of the brush modules 1210 is formed in a triangular shape in section, and the bristles 1211 are implanted in three vertices of each triangle.

Since rotation and revolution of the brush modules 1210 are decided by the brush gears and the inscribed gear 1150 which are engaged with each other, it is possible to arbitrarily set the position of each vertex contacting the floor.

Consequently, the position of the brush modules 1210, which are rotated and revolved, may be adjusted to set the contact angle between the bristles 1211 and the floor to an acute angle, an obtuse angle, or a right angle, thereby improving the contact angle between the bristles 1211 and the floor, such as carpet pile.

In addition, it is possible to adjust a mount angle of each of the brush modules 1210 such that the bristles 1211 provided at one of the brush modules 1210 does not interfere with the bristles 1211 provided at another adjacent one of the brush modules 1210 during the rotation of the brush modules 1210.

Although not shown in this embodiment, the bristles 1211 may be inclined at a predetermined angle a in the same manner as the bristles 311 of the third embodiment.

The other components of this embodiment are identical in construction to those of the sixth embodiment, and therefore a detailed description thereof will be omitted.

As is apparent from the above description, the robot cleaner according to the present invention has one or more of the following effects.

First, an elastic member is deformed due to contact force between bristles and a floor and then restored, and brush parts coupled to the elastic member are vibrated during deformation and restoration of the elastic member. Consequently, the robot cleaner according to the present invention has the effect of improving cleaning performance of the bristles.

Second, the bristles are inclined with respect to a normal direction of a brush shaft, and therefore the contact force between the ends of the bristles and the floor is increased. Consequently, the robot cleaner according to the present invention has the effect of improving cleaning performance.

Third, a displacement space for vibration is formed between every two neighboring ones of brush parts. Consequently, the robot cleaner according to the present invention has the effect of achieving smooth vibration of the brush parts.

Fourth, brush modules are revolved and, in addition, rotated in a direction opposite to a direction in which the brush modules are revolved. Consequently, the robot cleaner according to the present invention has the effect of increasing contact time between the bristles and the floor.

Fifth, brush gears mounted to the brush modules are engaged with an inscribed gear fixed to a case, and the brush gears are moved along the inscribed gear. Consequently, the robot cleaner according to the present invention has the effect of easily achieving rotation and revolution of the brush modules.

Sixth, the brush modules are mounted to brush coupling members. Consequently, the robot cleaner according to the present invention has the effect of simultaneously achieving revolution and rotation of the brush modules through rotation of the brush coupling members.

Seventh, revolution and rotation of the brush modules are achieved through engagement between the brush gears and the inscribed gear. Consequently, the robot cleaner according to the present invention has the effect of rotating the brush modules in the direction opposite to the direction in which the brush modules are revolved.

Eighth, the brush coupling members revolve the brush modules using power received from a traveling module. Consequently, the robot cleaner according to the present invention has the effect of rotating the brush modules in a direction opposite to the traveling direction and thus increasing contact time between the bristles and the floor.

Ninth, the robot cleaner according to the present invention has the effect of revolving and rotating the brush modules in opposite directions even in a case in which driving force is provided to the brush coupling members or the inscribed gear.

It should be noted that effects of the present invention are not limited to the effects of the present invention as mentioned above, and other unmentioned effects of the present invention will be clearly understood by those skilled in the art from the following claims.

It will be apparent that, although the preferred embodiments have been shown and described above, the present invention is not limited to the above-described specific embodiments, and various modifications and variations can be made by those skilled in the art without departing from the gist of the appended claims. Thus, it is intended that the modifications and variations should not be understood independently of the technical spirit or prospect of the present invention.

What is claimed is:

1. A robot cleaner comprising:

a case to move on a floor surface, the case forming an exterior of the robot cleaner;

a brush shaft attached at the case, whereby the brush shaft is rotated by a driving force received from a drive unit;

an elastic member attached at the brush shaft, whereby the elastic member is formed of an elastic material and extends the entire circumference of the brush shaft along the longitudinal direction of the brush shaft;

a plurality of brush parts attached at the elastic member, whereby the brush parts are formed of a rigid material, a plurality of bristles attached to each of the brush parts, wherein the brush parts vibrate during a deformation and a restoration of the elastic member when an external force is applied thereto, and a displacement space formed between adjacent brush parts, wherein the brush parts are disposed in the circumferential direction of the brush shaft, wherein each of the brush parts is in contact with an outer peripheral surface of the elastic member and is elongated in the longitudinal direction of the brush shaft, wherein an inner side of each of the brush parts extends in a circumferential direction on an outer peripheral surface of the elastic member, wherein an outside gap between outer sides of the brush parts forming the displacement space is wider than an inside gap between inner sides of the brush parts brought into contact with the elastic member.

2. The robot cleaner of claim 1, wherein the elastic member is integrally molded with the brush shaft.

3. The robot cleaner of claim 1, wherein the elastic member comprises an elastic member fixing part, and the brush comprises a brush fixing part attached at the elastic member fixing part.

4. The robot cleaner of claim 3, wherein one of the elastic member fixing part and the brush fixing part is formed in a concave shape, and the other is formed in a convex shape.

5. The robot cleaner of claim 1, wherein the bristles are inclined with respect to a normal direction of the brush shaft.

6. The robot cleaner of claim 5, wherein the bristles are inclined with respect to a rotating direction of the brush.

7. A robot cleaner comprising:

a case to move on a floor surface, the case forming an exterior of the robot cleaner; and a brush module disposed at a lower side of the case relative to the floor surface, wherein the brush module comprises:

a brush shaft attached at the case such that the brush shaft is rotated by driving force received from a drive unit;

an elastic member attached at the brush shaft, whereby the elastic member is formed of an elastic material and extends the entire circumference of the brush shaft along the longitudinal direction of the brush shaft; and a plurality of brush parts fixed to the elastic member, whereby the brush parts are formed of a rigid material, a plurality of bristles attached to each of the brush parts such that the bristles contact the floor surface when the brush parts are rotated, and a displacement space formed between adjacent brush parts, wherein the brush parts are disposed in the circumferential direction of the brush shaft, wherein each of the brush parts is in contact with an outer peripheral surface of the elastic member and is elongated in the longitudinal direction of the brush shaft, wherein an inner side of each of the brush parts extends in a circumferential direction on an outer peripheral surface of the elastic member, wherein an outside gap between outer sides of the brush parts forming the displacement space is wider than an inside gap between inner sides of the brush parts brought into contact with the elastic member.

8. The robot cleaner of claim 7, wherein the bristles are inclined with respect to a normal direction of the brush shaft.

9. A robot cleaner comprising:

a case to move on a floor surface, the case forming an exterior of the robot cleaner; and an agitator unit disposed at a lower side of the case relative to the floor surface, wherein the agitator unit comprises:

a plurality of brush modules each having bristles configured to contact the floor surface, a brush shaft attached at each of the brush modules about which each of the brush modules is rotated;

a plurality of brush gears, whereby one of the plurality of brush gear is attached at each of the brush modules;

an inscribed gear attached at the case such that each of the brush gears is engaged with the inscribed gear; and a drive unit to revolve the brush gears along the inscribed gear and to rotate the brush gears about the respective brush shafts in a direction opposite to the revolving direction when the brush gears are engaged with the inscribed gear, wherein each of the brush modules comprises:

an elastic member attached at the brush shaft, whereby the elastic member is formed of an elastic material and extends the entire circumference of the brush shaft along the longitudinal direction of the brush shaft;

a plurality of brush parts attached to the elastic member, whereby the brush parts are formed of a rigid material, a plurality of bristles attached to each of the brush parts, whereby the brush parts vibrate during a deformation and a restoration of the elastic member when an external force is applied thereto, a displacement space formed between adjacent brush parts, and wherein a plurality of the brush part are disposed, wherein the plurality of the brush parts are disposed in the circumferential direction of the brush shaft, wherein each of the brush parts is in contact with an outer peripheral surface of the elastic member and is elongated in the longitudinal direction of the brush shaft, wherein an inner side of each of the brush parts extends in a circumferential direction on an outer peripheral surface of the elastic member, wherein an outside gap between outer sides of the brush parts forming the displacement space is wider than an inside gap between inner sides of the brush parts brought into contact with the elastic member.

10. The robot cleaner of claim 9, wherein the brush modules revolve in a traveling direction of the robot cleaner and rotate in a direction opposite to the traveling direction.

11. The robot cleaner of claim 9, further comprising:

a brush coupling member that is coupled to the brush modules, wherein the drive unit rotates the brush coupling member such that the brush modules revolve in a traveling direction of the robot cleaner.

12. The robot cleaner of claim 11, wherein the brush gears are respectively disposed at a middle length position of each of the brush modules, and the brush coupling member is disposed at ends of each of the brush modules.

13. The robot cleaner of claim 11, wherein the brush gears are respectively disposed at ends of each of the brush modules, and the brush coupling member is disposed at a middle length position of each of the brush modules.

14. The robot cleaner of claim 11, wherein the drive unit provides a driving force to one of the brush coupling member and the inscribed gear.

15. The robot cleaner of claim 9, wherein the bristles are inclined with respect to a normal direction of the brush shaft.

* * * * *